US005474188A

United States Patent [19]

McArdle

[11] Patent Number: 5,474,188

[45] Date of Patent: Dec. 12, 1995

[54] FRUIT/VEGETABLE STORAGE UNIT

[76] Inventor: Christopher J. McArdle, 8648 Surrey La., Alta Loma, Calif. 91701

[21] Appl. No.: 199,577

[22] Filed: Feb. 22, 1994

[51] Int. Cl.[6] ..... A47F 7/00

[52] U.S. Cl. ..... 211/13; 248/127; 248/163.2; D7/602

[58] Field of Search ..... 211/13, 87, 88; 5/120, 129; 248/127, 163.2, 176; D7/602

[56] References Cited

U.S. PATENT DOCUMENTS

| | | | |
|---|---|---|---|
| 855,493 | 6/1907 | App | 248/163.2 X |
| 2,450,689 | 10/1948 | Richmond | 5/129 |
| 2,469,950 | 5/1949 | Carl | 5/129 |
| 2,563,156 | 8/1951 | Carl | 5/129 X |
| 4,664,266 | 5/1987 | Fausett et al. | 211/87 |
| 5,113,538 | 5/1992 | Branch, III | 5/120 X |

FOREIGN PATENT DOCUMENTS

| | | | |
|---|---|---|---|
| 523007 | 7/1940 | United Kingdom | 248/163.2 |

*Primary Examiner*—Robert W. Gibson, Jr.

[57] ABSTRACT

A storage unit for fruit and vegetables consisting of a stand which includes a pair of spaced upwardly extending end members, and a soft open-weave fabric net suspended between the end members for supporting fruit and vegetables in a suspended manner in mid air displaced up from the stand.

2 Claims, 2 Drawing Sheets

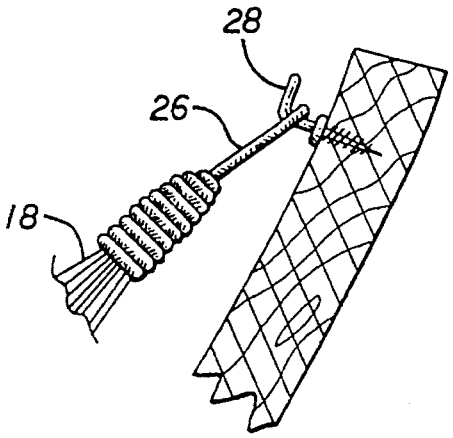
FIG. 3
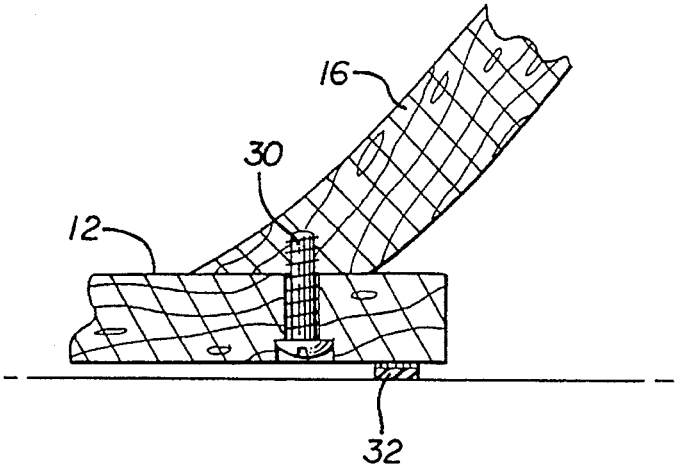
FIG. 4
FIG. 5
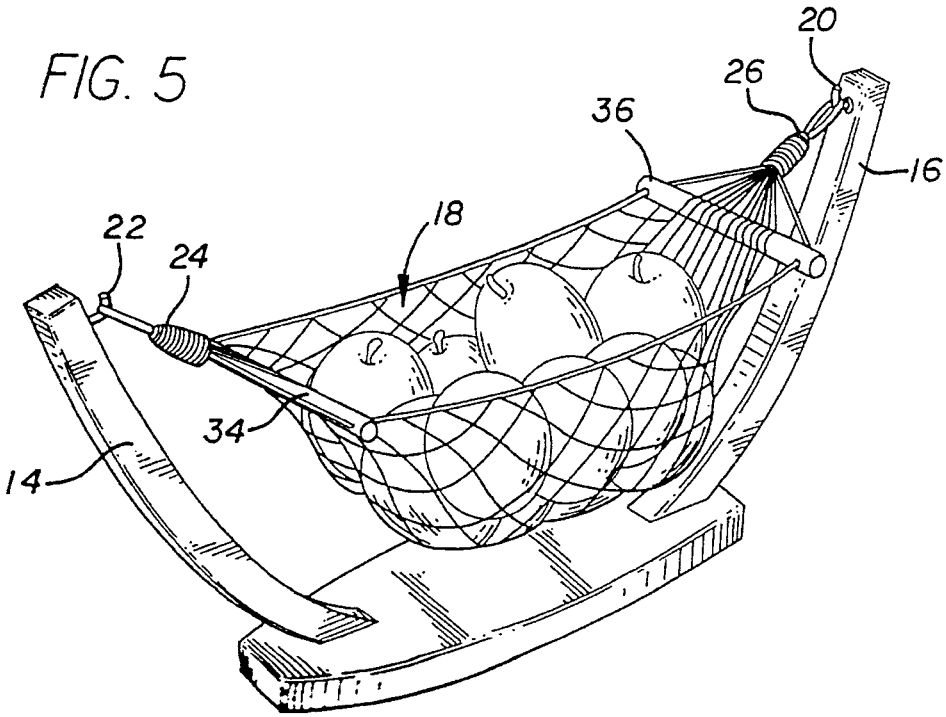

FRUIT/VEGETABLE STORAGE UNIT

BACKGROUND OF THE INVENTION

The invention provides a unit for storing fruit and vegetables consisting of a stand which includes a pair of spaced, upwardly extending end members, and a soft fabric-like open weave net suspended between the end members for supporting fruit and vegetables in a completely suspended manner in mid air. The assembly of the invention constitutes a means for supporting fruit and vegetables on the kitchen counter or table in an improved, unique, novel and attractive manner. The net is formed, for example, of a soft fabric-like open weave to provide a convenient support for the fruit and vegetables, and permitting the fruit and vegetables to be suspended in an attractive manner for improved fresh air circulation around and between the fruit or vegetables.

The improved unit of the invention is a distinct improvement over existing fruit and vegetable storage devices such as fruit bowls and baskets which all fail to provide for the free flow of air around and through the fruit. In addition, many of the prior art devices present hard surfaces to the fruit which cause bruises and soft spots.

BRIEF DESCRIPTION OF THE DRAWINGS

FIG. 3 is a fragmentary view designated by the number and arrows 3 in FIG. 2;

FIG. 4 is a fragmentary view designated by the arrows 4 in FIG. 2; and FIG. 5 is a perspective view, like FIG. 1, of a second embodiment.

DETAILED DESCRIPTION OF THE ILLUSTRATED EMBODIMENTS

Figure 1:
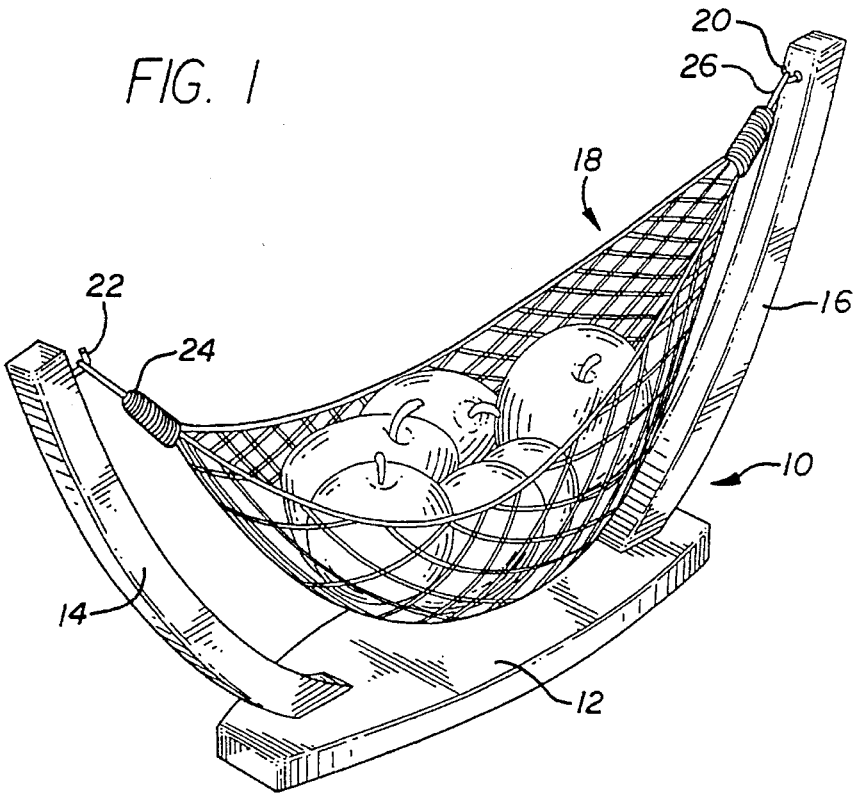
FIG. 1 is a perspective view of the unit of the invention taken from one side and above the assembly, and showing fruit contained in the assembly for display purposes.
Figure 2:
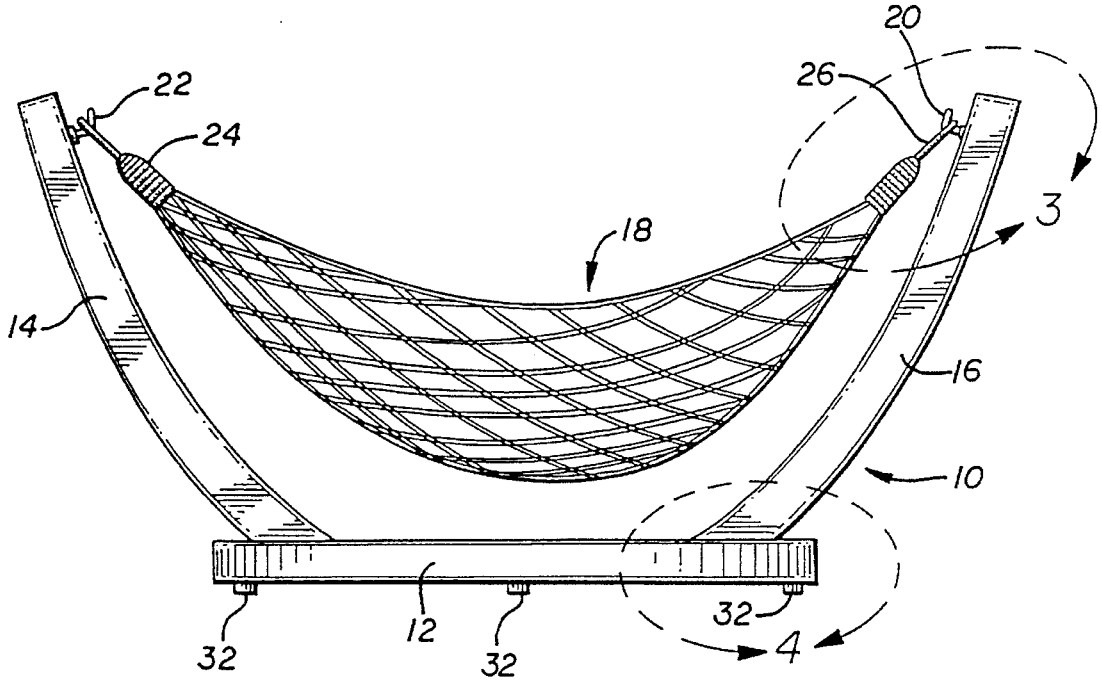
FIG. 2 is a side elevational view of the assembly of FIG. 1.

Referring now to the drawings, and particularly FIGS. 1–4, the assembly of the invention in accordance with the first embodiment includes a stand 10 formed of a flat base 12, and a pair of arcuate end members 14 and 16 mounted on opposite ends of base 12 and extending upwardly from the base in a mutually spaced relationship.

An open weave net 18 formed of soft fabric-like material is suspended between the end members 14 and 16, and is held in place, for example, by L-screws 20 and 22 mounted on the end members and looped cords 24 and 26 secured to the ends of the net 18. The elements described above are shown in the fragmentary view of FIG. 3. The end members 14 and 16 may be secured to base 12 by screws, such as screw 30 in FIG. 4.

Rubber-like pedestals 32 may be mounted on the underside of base 12 so that-the base may be supported on any appropriate surface without scratching. The stand is designed and constructed to form a stable support for the net 18 on any appropriate supporting surface.

The embodiment of FIG. 5 is similar in some respects to that of FIGS. 1–4, and like elements have been designated by the same numbers. The embodiment of FIG. 5 includes cross members 34 and 36 inserted at each end of net 18 to provide means for spacing the sides of the net apart to render it more convenient to insert fruit and vegetables into the net and to provide increased volume for supporting the fruit and vegetables.

The invention provides, therefore, a simple and inexpensive means for storing fruit and vegetables suspended in a soft fabric-like open weave net for improved air circulation, less bruising, fewer soft spots, more even ripening, and less spoilage as compared with other prior art storage devices.

It will be appreciated that while particular embodiments of the invention have been shown and described, modifications may be made. It is intended in the claims to cover all such modifications which fall within the true spirit and scope of the invention.

I claim:

1. In combination: a pliable soft fabric-like open weave net member configured as a pocket to hold and display fruit and vegetables on a counter or table in a manner to permit air circulation around and between and fruit and vegetables; and means for supporting said net member at its ends to cause said pliable fabric-like net member to be suspended so as to hold the fruit and vegetables in mid air, said supporting means comprising a stand including a base member and a pair of upwardly extending elongated end members supported by said base member, and in which said pliable net member is suspended between the distal ends of said end members displaced up from said base member.

2. The combination defined in claim 1 and which includes a pair of rigid elongated spacer members inserted into said fabric-like member at its respective ends.

* * * * *